US007452041B2

(12) United States Patent
Edelen et al.

(10) Patent No.: US 7,452,041 B2
(45) Date of Patent: Nov. 18, 2008

(54) INK JET HEATER CHIP WITH INTERNALLY GENERATED CLOCK SIGNAL

(75) Inventors: John Glenn Edelen, Versailles, KY (US); Kristi Maggard Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 972 days.

(21) Appl. No.: 10/636,928

(22) Filed: Aug. 7, 2003

(65) Prior Publication Data

US 2005/0030344 A1 Feb. 10, 2005

(51) Int. Cl.
*B41J 29/38* (2006.01)

(52) U.S. Cl. ..... 347/5; 347/9; 347/12

(58) Field of Classification Search ..... 347/5, 347/9, 12; 375/362
See application file for complete search history.

(56) References Cited

U.S. PATENT DOCUMENTS

| | | | | |
|---|---|---|---|---|
| 3,673,564 | A * | 6/1972 | Kammerer | 340/475 |
| 4,002,834 | A * | 1/1977 | Cocci et al. | 375/362 |
| 4,203,030 | A * | 5/1980 | Moran | 377/51 |
| 4,963,885 | A | 10/1990 | Yasunaga et al. | 346/76 |
| 5,790,140 | A | 8/1998 | Koizumi et al. | 347/12 |
| 5,838,339 | A | 11/1998 | Silverbrook | 347/9 |
| 5,940,608 | A | 8/1999 | Manning | 395/558 |
| 6,027,195 | A | 2/2000 | Gauthier et al. | 347/5 |
| 6,076,922 | A | 6/2000 | Knierim | 347/103 |
| 6,547,356 | B2 | 4/2003 | Edelen et al. | 347/12 |
| 6,619,775 | B2 * | 9/2003 | Tsuruoka | 347/5 |

FOREIGN PATENT DOCUMENTS

| | | |
|---|---|---|
| EP | 0 749 089 A2 | 12/1996 |
| JP | 63137848 | 6/1988 |
| JP | 5031898 | 2/1993 |
| JP | 8034137 | 2/1996 |
| JP | 198202 | 7/2000 |

OTHER PUBLICATIONS

Overview of 1-Wire Technology and Its Use, Application Note 1796: Dec. 3, 2002, www.maxim-ic.com/an1796, Dallas Semiconductor/ Maxim.

* cited by examiner

*Primary Examiner*—Lam S Nguyen
(74) *Attorney, Agent, or Firm*—Dinsmore & Shohl, LLP

(57) ABSTRACT

A method for generating a clock pulse train within a heater chip of an ink jet printer that is used to serially load data into the chip eliminates the need for an externally generated clock signal. These heater chips with internally generated clock signals allow for reduced print head cost.

30 Claims, 5 Drawing Sheets

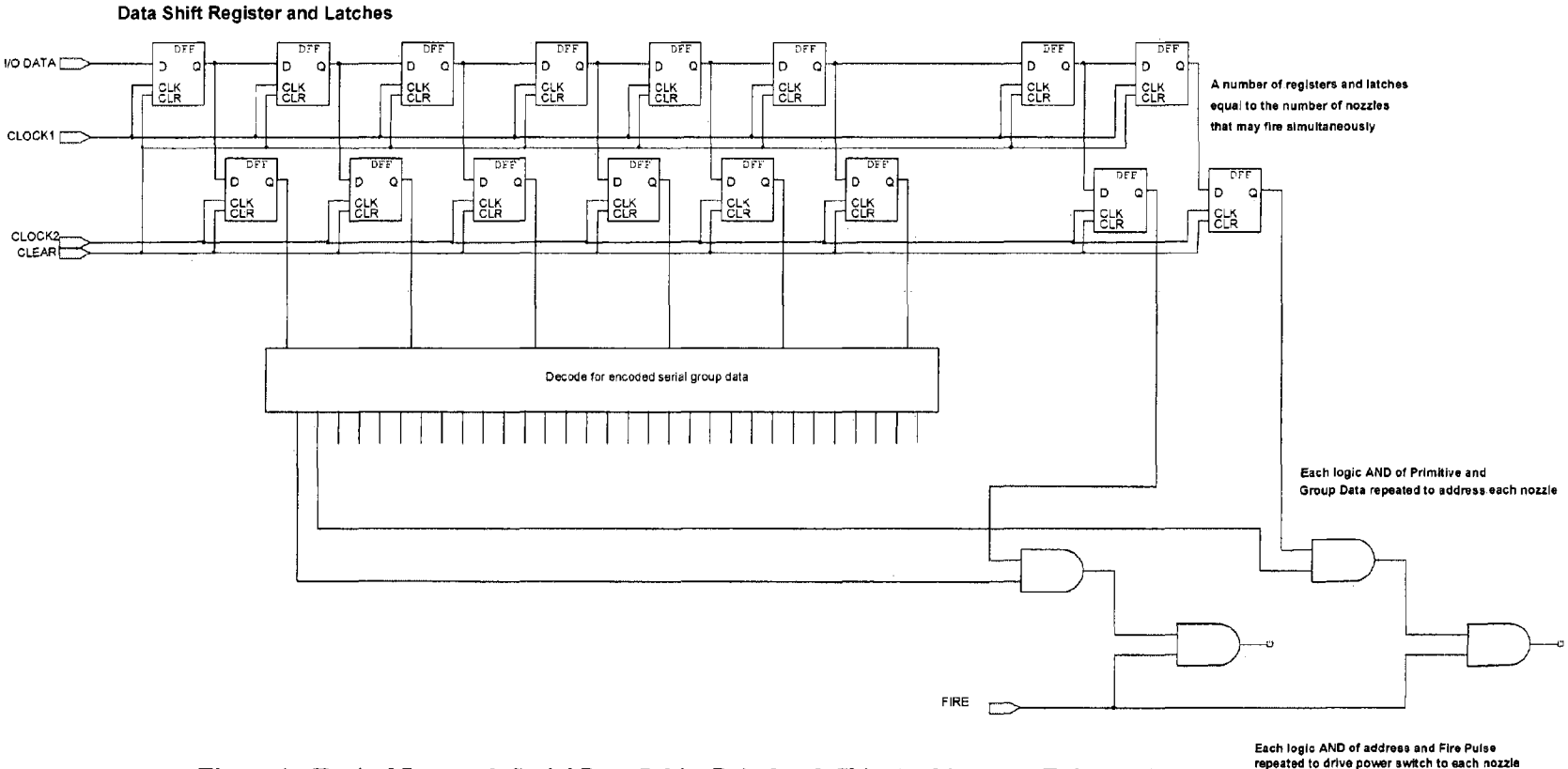
Figure 1: Typical Lexmark Serial Data Inkjet Printhead Chip Architecture (Prior Art).
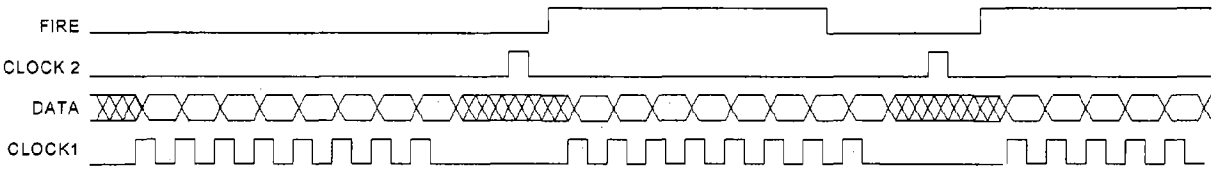
Figure 2: Timing Diagram for Current Lexmark Serial Data Inkjet (Prior Art).

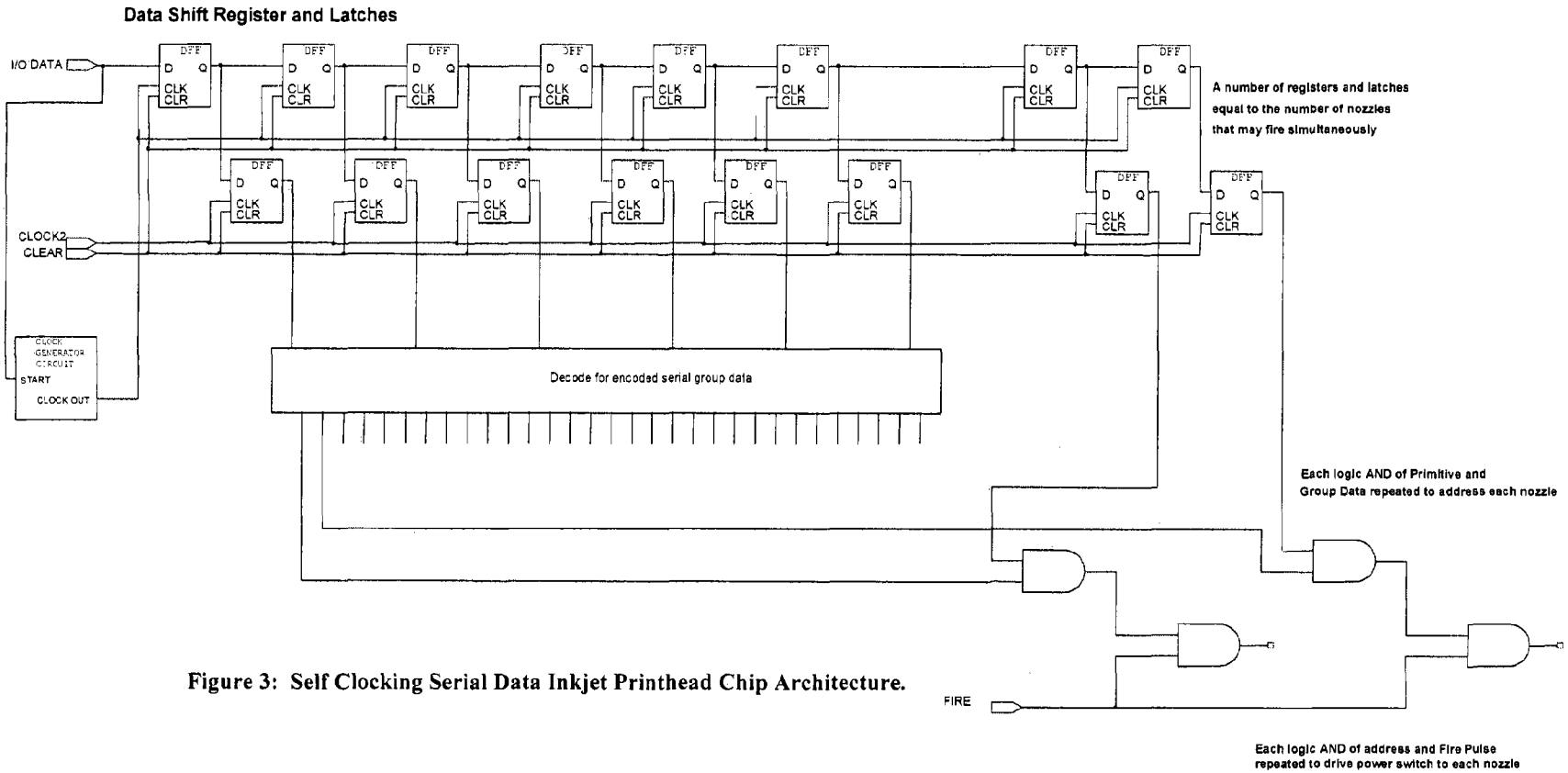
Figure 3: Self Clocking Serial Data Inkjet Printhead Chip Architecture.
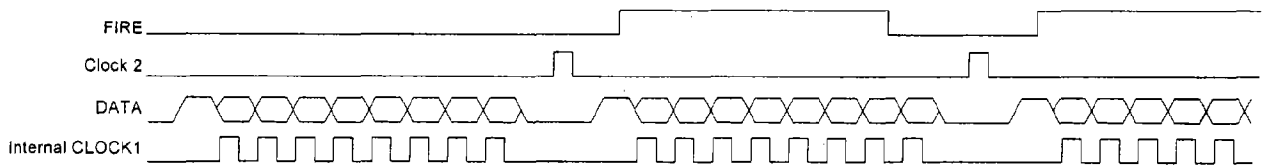
Figure 4: Timing Diagram with START Bit as Part of Data Stream.

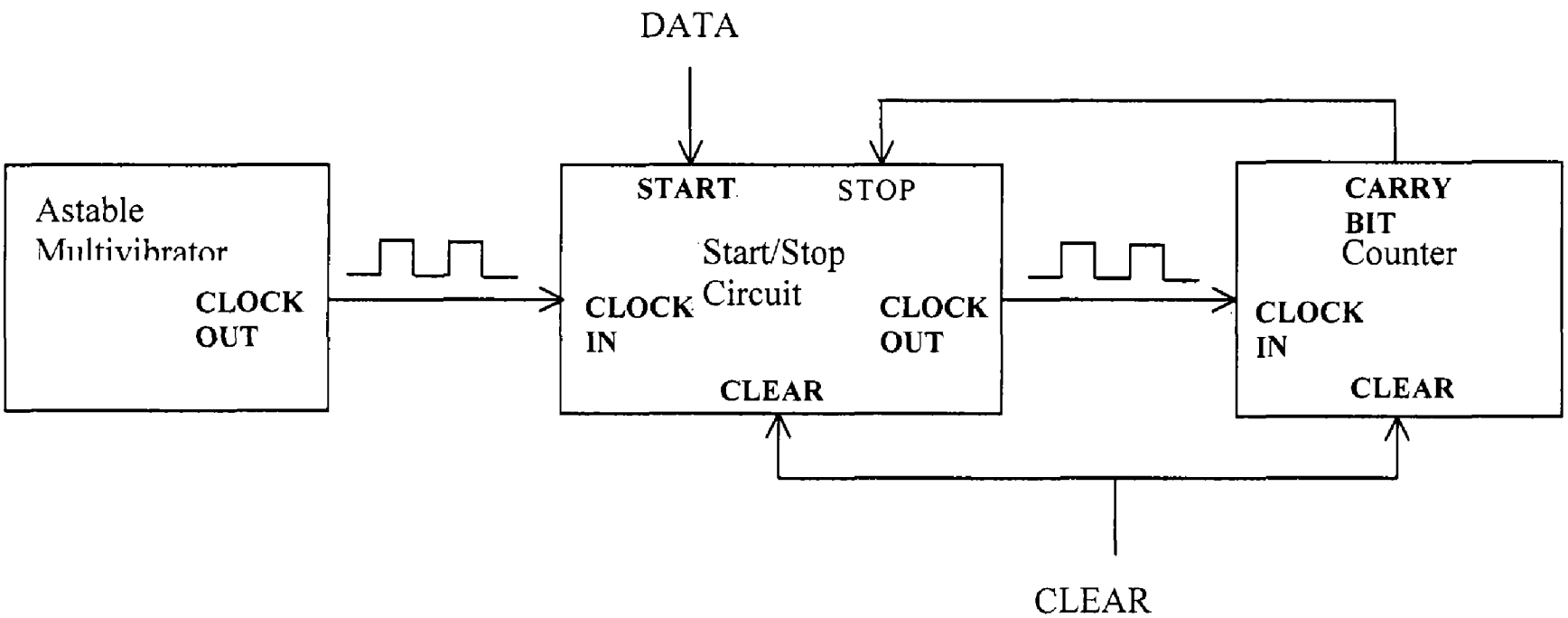
Figure 5: Block Diagram of Clock Generator Circuit.

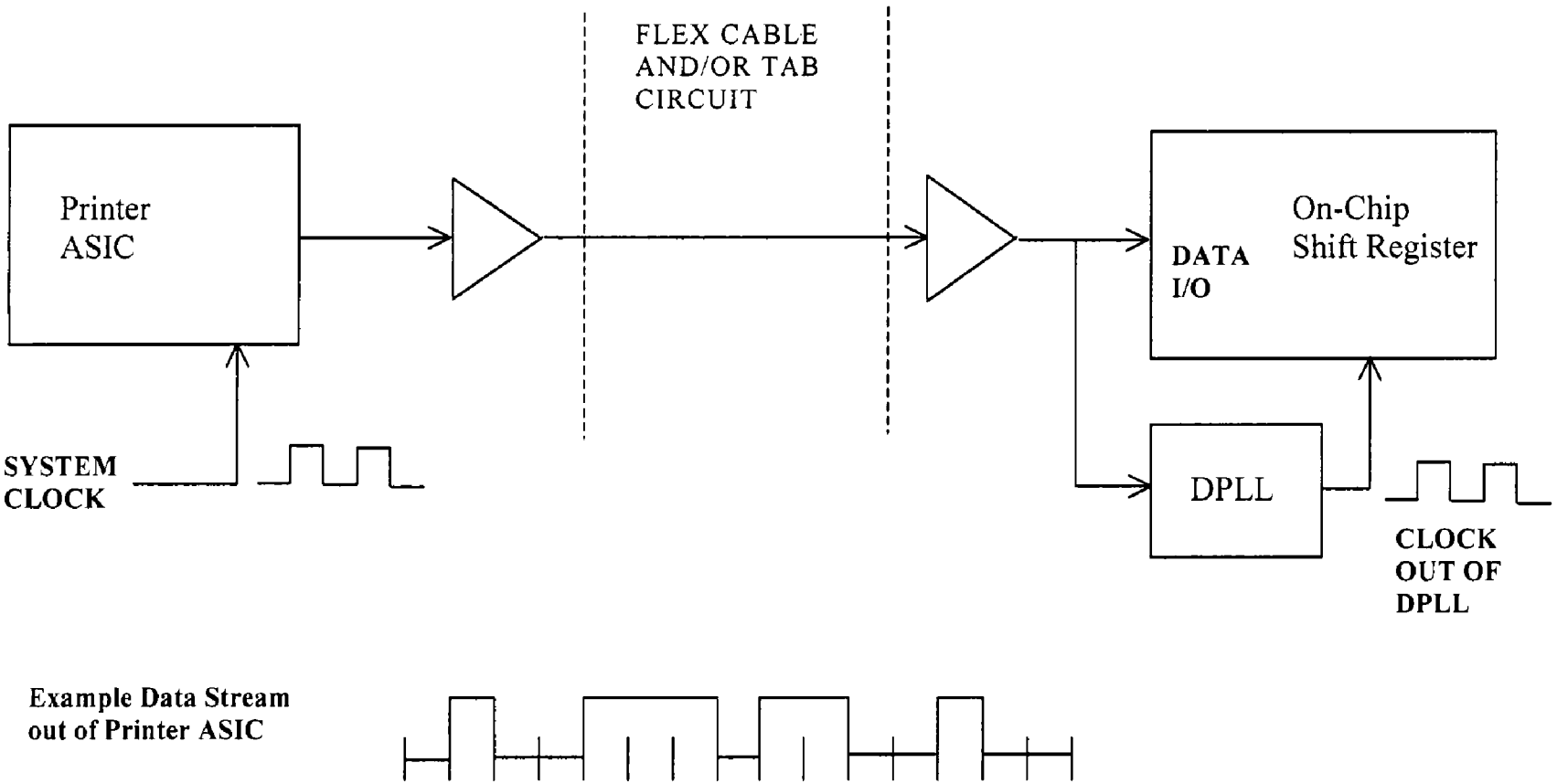
Figure 6: Block Diagram of Digital Phase Locked Loop Implementation.

INK JET HEATER CHIP WITH INTERNALLY GENERATED CLOCK SIGNAL

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to printers. More particularly, the present invention relates to ink jet printers.

2. General Background of the Invention

One of the primary goals when designing inkjet heater chips is to create a product that will reduce the overall cost of the finished print head assembly and where possible the printer itself. One method that meets these goals is to reduce the number of I/O pads required by the chip. By reducing the number of I/Os the following benefits can be realized:

1.) The tab circuit size can be reduced.
2.) The number of interconnects between print head, tab circuit and printer carrier card can be reduced.
3.) More chip area can be used for integrated circuits.
4.) The potential for EMR from the printhead flex cable is reduced.

Present Lexmark serially loaded printheads require at a minimum a data input signal, a clock input signal and a load input signal.

The following patent documents, and all patents and patent documents mentioned herein, are incorporated herein by reference:

U.S. Pat. Nos. 6,076,922; 6,027,195; 5,940,608; 5,838,339; 5,790,140; 4,963,885; Japanese patent document nos.: JP 8034137; JP 63137848; JP 5031898; and JP 198202; European publication no. EP 0 749 089 A2.

U.S. Pat. No. 6,076,922 to Knierim describes a method and apparatus for generating a dot clock signal for controlling operation of a print head. The system is for a printer that includes an image transfer drum and a printhead for ejecting drops of ink toward the image transfer drum. A control mechanism controls operation of the printhead. The control mechanism includes a position encoder that generates an encoder signal and a digital phase locked loop circuit that receives the encoder signal and generates the dot clock signal. Firing of the print head is controlled by the dot clock signal. Knierim appears to disclose an off carrier circuit for generating a firing clock based upon readings of an encoder strip.

U.S. Pat. No. 5,940,608 to Manning describes a clock generator circuit for an integrated circuit that includes a phase detector for comparing the phase of a delayed external clock signal to the phase of an internal clock signal. An error signal corresponding to the difference in phase between the two clock signals is applied to a differential amplifier where the error signal is offset by a value corresponding to the delay of an external clock signal. The offset error signal is applied to the control input of a voltage controlled oscillator which generates the internal clock signal.

U.S. Pat. No. 5,790,140 to Koizumi et al. describes a printing head that resets the count value of a counter in response to an externally supplied signal. This externally supplied signal is described as a clock signal supplied from the head driver. The decoder generates a selection signal in accordance with the count value and selects a divided heat-generating element group. An electric current is then supplied to heat-generating resistors in the selected group to perform a printing operation. According to the '140 patent, the printer can thus be controlled by a smaller number of control signals.

Our Lexmark U.S. Pat. No. 6,547,356 describes creating a second clock for latching serial data in a heater chip. The second clock moves the data from an internal shift register to internal latches on a heater chip. The second clock is created from an extra bit in the data shift register. The extra bit is used as a trigger for the second clock. After a predetermined delay occurs from when the data is completely shifted in, the extra bit in the shift register, when enabled, triggers the second clock to occur and move the data from the shift register to latches.

BRIEF SUMMARY OF THE INVENTION

The present invention comprises a method to eliminate the clock input signal in an ink jet printer heater chip. The apparatus of the present invention includes an ink jet heater chip with an internally generated clock signal.

The present invention relates to a method for generating a clock pulse train within the heater chip of an ink jet print head cartridge that is used to serially load data into and out of shift registers located on the heater chip. In one embodiment, a clock signal of the desired frequency is internally generated on the heater chip by an Astable Multivibrator Circuit. This clock signal is input to a Start/Stop Circuit. The Start/Stop Circuits output is then synchronized with the beginning and end of the incoming data stream. Preferably, this synchronization is accomplished by using the incoming data bits to enable the output of the Start/Stop Circuit and using a carry bit from a counter to disable the output of the Start/Stop Circuit. In an alternative embodiment, a clock signal is derived from the incoming data stream by a digital phase-locked loop (DPLL) on the printhead silicon. This clock signal is then used to read data into and out of the shift registers on the heater chip.

The '922 patent to Knierim does not appear to describe or suggest a print head cartridge wherein a clock signal is derived on the print head from an incoming data stream and wherein this clock signal is then used to read data into and out of the shift registers on the heater chip. The '608 patent does not appear to describe or suggest an ink jet head that does not require a clock input. The '608 patent also does not appear to disclose internally generating a clock signal of the desired frequency on a heater chip with an Astable Multivibrator Circuit and using this clock signal as an input to a Start/Stop Circuit that is synchronized with the beginning and end of an incoming data stream. The '140 patent does not appear to describe or suggest a print head that does not require a clock input. In fact, the '140 patent states that the head driver supplies a clock signal to the print head. Thus, the counter of the '140 patent does not appear to function in the same manner as the counter of the present invention.

The apparatus of the present invention comprises:

an ink jet heater chip comprising:

a plurality of ink jet nozzles;

a plurality of data shift registers;

a plurality of latches; and a first clock signal generator on the ink jet heater chip for generating a first clock signal, wherein the first clock signal is used to shift data into and through the data shift registers. The apparatus preferably further comprises a data I/O, a second clock signal generator which produces a second clock signal, an internal bus, and a set of latches that load the Group Data and/or Primitive Data bits onto the internal bus, wherein the data is input through the data I/O and, once all the data in a data cycle has been scanned into the shift registers, the second clock signal controls the set of latches that load the Group Data and/or Primitive Data bits onto the internal bus.

The first clock signal can be derived on the ink jet heater chip from an incoming data stream, such as by a clock-recovery circuit. The first clock signal generator can comprise an oscillator circuit, such as an astable multivibrator circuit, which generates a continuous train of pulses at a desired frequency. The train of pulses can feed into a Start/Stop Circuit which acts as a gate for the pulse train. The initial state of the Start/Stop circuit can be off and the first data bit in the data stream can act as the START BIT.

Preferably, the second clock signal generator is also on the ink jet heater chip. In such a case, the second clock signal can be derived on the ink jet heater chip from an incoming data stream, as by a clock-recovery circuit. Alternatively, the second clock signal generator can include a counter on the ink jet heater chip which sends a second clock signal after a predetermined number of first clock signals, or the second clock signal generator can comprise an oscillator circuit, such as an astable multivibrator circuit, which generates a continuous train of pulses at a desired frequency. The train of pulses can feed into a Start/Stop Circuit which can act as a gate for the pulse train. The initial state of the Start/Stop circuit can be off and the first data bit in the data stream can act as the START BIT.

The present invention also includes apparatus comprising:

an ink jet heater chip comprising:

a plurality of ink jet nozzles;

a plurality of data shift registers; and a plurality of latches;

a first clock signal generator for generating a first clock signal, wherein the first clock signal is used to shift data into and through the data shift registers;

a data I/O, a second clock signal generator which produces a second clock signal, an internal bus, and a set of latches that load the Group Data and/or Primitive Data bits onto the internal bus, wherein the data is input through the data I/O and, once all the data in a data cycle has been scanned into the shift registers, the second clock signal controls the set of latches that load the Group Data and/or Primitive Data bits onto the internal bus, wherein:

the second clock signal generator is on the ink jet heater chip and comprises an oscillator circuit, such as an astable multivibrator circuit.

The present invention can also comprise apparatus comprising:

an ink jet heater chip comprising:

a plurality of ink jet nozzles;

a plurality of data shift registers; and a plurality of latches; and a first clock signal generator for generating a first clock signal, wherein the first clock signal is used to shift data into and through the data shift registers;

a data I/O, a second clock signal generator which produces a second clock signal, an internal bus, and a set of latches that load the Group Data and/or Primitive Data bits onto the internal bus, wherein the data is input through the data I/O and, once all the data in a data cycle has been scanned into the shift registers, the second clock signal controls the set of latches that load the Group Data and/or Primitive Data bits onto the internal bus, wherein:

the second clock signal generator is on the ink jet heater chip and includes a counter on the ink jet heater chip which sends a second clock signal after a predetermined number of first clock signals.

The present invention also comprises an ink jet print head cartridge including the ink jet heater chip of the present invention, as well as an ink jet print head including the ink jet heater chip, as well as an ink jet printer including the inkjet print head.

The present invention also includes a method of printing comprising:

providing an ink jet printer having an ink jet heater chip comprising:

a plurality of ink jet nozzles;

a plurality of data shift registers;

a plurality of latches; and generating a first clock signal on the ink jet heater chip, wherein the first clock signal is used to shift data into and through the data shift registers. Preferably, the printer further comprises a data I/O, a second clock signal generator which produces a second clock signal, an internal bus, and a set of latches that load the Group Data and/or Primitive Data bits onto the internal bus, wherein the data is input through the data I/O and, once all the data in a data cycle has been scanned into the shift registers, the second clock signal controls the set of latches that load the Group Data and/or Primitive Data bits onto the internal bus. The first clock signal can be derived, as by a clock-recovery circuit, on the ink jet heater chip from an incoming data stream; alternatively, the first clock signal generator can comprise an oscillator circuit, such as an astable multivibrator circuit, which generates a continuous train of pulses at a desired frequency. The train of pulses can feed into a Start/Stop Circuit which acts as a gate for the pulse train. The initial state of the Start/Stop circuit can be off and the first data bit in the data stream can act as the START BIT.

The novel ink jet heater chips of the present invention can be used in various types of ink jet printers (such as Lexmark® Model Z51, Lexmark® Model Z31, and Lexmark® Model Z11 , Lexmark® Photo Jetprinter 5770, or Kodak® PPM200).

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 1 shows typical prior art Lexmark serial data inkjet printhead chip architecture;

FIG. 2 shows a prior art timing diagram for a current Lexmark serial data ink-jet;

FIG. 3 shows self-clocking serial data inkjet printhead chip architecture of a preferred embodiment of the present invention.

FIG. 4 shows a timing diagram of a preferred embodiment of the present invention with START bit as part of data stream.

FIG. 5 shows a block diagram of a clock generator circuit.

FIG. 6 is a block diagram of digital phase locked loop implementation;

DETAILED DESCRIPTION OF THE INVENTION

Figure 8:
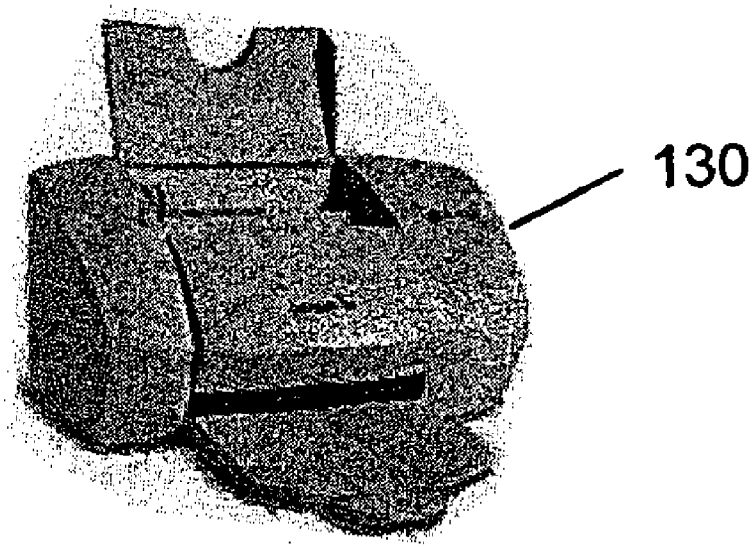
FIG. 8 shows a preferred embodiment of the inkjet printer of the present invention.

This present invention provides a method for eliminating the external clock input from an ink jet heater chip. There are two preferred primary ways to accomplish this. The first preferred method is by internally generating a clock of the desired frequency and synchronizing the clock start and stop with the beginning and end of a data stream. The second preferred method is to derive the clock from the incoming data stream.

FIGS. 1 and 2 illustrate a basic serial inkjet architecture and timing diagram respectively. In a serial data stream inkjet, the data is input through a single data I/O and shifted through a shift register with the primary clock signal, Clock 1. Once all the data in the data cycle has been scanned into the shift register, a second clock, Clock 2 , controls a set of latches that load the Group Data and/or Primitive Data bits onto the internal bus.

FIG. 1 shows data shift registers and latches. In FIG. 1, there are preferably a number of registers and latches equal to the number of ink jet nozzles that may fire simultaneously; each logic AND of Primitive and Group Data are repeated to address each nozzle; each logic AND of address and Fire Pulse are repeated to drive the power switch to each nozzle.

Lexmark U.S. Pat. No. 6,312,079 explains the basic operation of the prior art system of FIGS. 1 and 2.

The first embodiment of the present invention replaces the Clock 1 input with an internal circuit, which generates a train of clock pulses as well as a method for synchronizing the internally generated Clock 1 with the incoming data stream. FIG. 3 shows a high level representation of how such a circuit could be implemented within the present architecture; FIG. 3 shows a clock generator circuit block added to the present design, which replaces the Clock 1 input of FIG. 1. FIG. 4 shows a modified timing diagram with the addition of a start bit.

A more detailed block diagram is shown in FIG. 5, where an Astable Multivibrator Circuit on the chip generates a continuous train of pulses at the desired frequency. This train of pulses feeds into a Start/Stop Circuit which acts as a gate for the pulse train. The initial state of the Start/Stop circuit is off, meaning that the CLK OUT node is not oscillating. The first data bit in the data stream acts as the START BIT. When this bit goes low to high, as shown in FIG. 4, the CLK OUT node will be set to follow the CLK IN node. The COUNTER circuit will be configured so that the CARRY BIT will go low to high after the correct number of clock cycles have occurred. When this happens the CARRY BIT will set the STOP node to high and turn the Start/Stop circuit off. This ends the input of one data stream.

There are a multitude of methods to implement the block diagram in FIG. 5 that will be apparent to those of ordinary skill in this field. The circuit details are not shown in that it is the generation of the serial stream clock train on an ink jet heater chip which is unique and the primary focus of this invention. When the clock is generated on the chip one would normally expect significant variation in the generated frequency due to silicon process variations. What makes the method of the present invention practical is that the relatively slow clock rates required allow for the generated frequency to vary by as much as 40% from chip to chip without affecting operation. This variation is reasonable for the present fabrication process.

In cases where tighter tolerances are required, a more complicated circuit could be used. One such circuit is a clock-recovery circuit, also know as a Digital Phase-Locked Loop (DPLL). Such a circuit is capable of deriving a clock signal from an input data stream. The block diagram for such a circuit is shown in FIG. 6. Again, the details of implementation are not shown as they will be apparent to those of ordinary skill in this field.

The second clock (Clock 2 ) can also be located on the heater chip, and can be generated with a clock-recovery circuit, an astable multivibrator circuit or any other oscillator circuit. The second clock could be generated from the incoming data stream (as shown in our Lexmark U.S. Pat. No. 6,547,356). The second clock will always be at a slower frequency than the first clock (as shown in FIG. 2).

Also, the second clock could simply be a counter (preferably on the heater chip) which counts the signals of the first clock (Clock 1 ) and sends a second clock signal after a certain predetermined number of signals of the first clock.

The chips of the present invention can be used in various types of ink jet print heads, such as those shown in Lexmark's U.S. Pat. Nos. 6,398,333 and 6,382,758 (both incorporated herein by reference).

Aside from the novel ink jet heater chips of the present invention, print head 120 can be the same as the print heads of Lexmark's U.S. Pat. Nos. 6,540,334; 6,398,346; 6,357,863; 5,984,455; 5,942,900.

Figure 7:
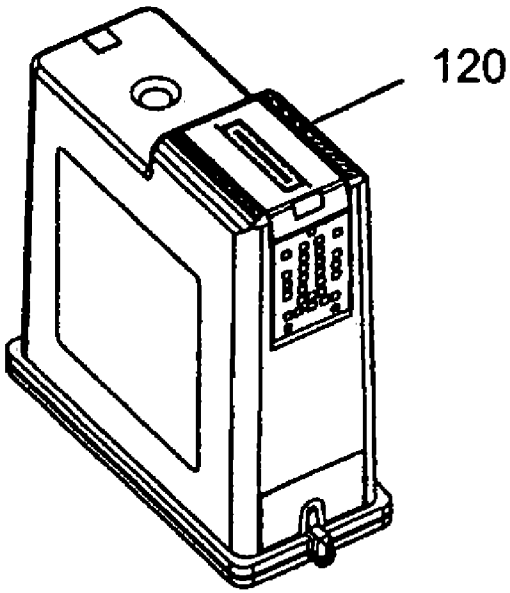
FIG. 7 shows an inkjet print head of the present invention including an ink-jet print head chip of the present invention.

FIG. 7 shows an inkjet print head 120 of the present invention. FIG. 8 shows an inkjet printer 130 including print head 120. Aside from the novel ink jet heater chips of the present invention, printer 130 can be the same as current Lexmark printers (such as Lexmark® Model Z51, Lexmark® Model Z31, and Lexmark® Model Z11).

The present invention includes ink jet heater chips having internally generated clock signals. For elements of the present invention not shown herein, see one or more of the U.S. patents mentioned herein (e.g., Lexmark U.S. Pat. No. 6,547,356 for "Latching serial data in an ink jet print head"; Lexmark U.S. Pat. No. 6,575,562 for "Performance inkjet printhead chip layouts and assemblies"; Lexmark U.S. Pat. No. 6,404,834 for "Segmented spectrum clock generator apparatus and method for using same"; Lexmark U.S. Pat. No. 6,382,758 for "Printhead temperature monitoring system and method utilizing switched, multiple speed interrupts"; Lexmark U.S. Pat. No. 6,366,174 for "Method and apparatus for providing a clock generation circuit for digitally controlled frequency or spread spectrum clocking"; Lexmark U.S. Pat. No. 6,167,103 for "Variable spread spectrum clock"; Lexmark U.S. Pat. No. 6,099,101 for "Disabling refill and reuse of an ink jet print head" (includes a clock on a print cartridge—see col. 7, lines 27-29); Lexmark U.S. Pat. No. 5,872,807 for "Spread spectrum clock generator and associated method"; Lexmark U.S. Pat. No. 5,867,524 for "Spread spectrum clock generator and associated method"; Lexmark U.S. Pat. No. 5,774,148 for "Printhead with field oxide as thermal barrier in chip"; Lexmark U.S. Pat. No. 5,631,920 for "Spread spectrum clock generator"; Lexmark U.S. Pat. No. 5,488,627 for "Spread spectrum clock generator and associated method"), all of which are incorporated herein by reference.

Parts List

The following is a list of parts and symbols used herein:

| | |
|---|---|
| ASIC | application specific integrated circuit |
| CLK | clock |
| CLR | clear |
| D | data input of flip flop |
| DFF | data flip flop |
| DPLL | digital phase locked loop |
| I/O | input/output |
| Q | data output of flip flop |
| 120 | inkjet print head of the present invention |
| 130 | inkjet printer including print head 120 |

All measurements disclosed herein are at standard temperature and pressure, at sea level on Earth, unless indicated otherwise.

The foregoing embodiments are presented by way of example only; the scope of the present invention is, to be limited only by the following claims.

The invention clamed is:

1. Apparatus comprising:

an ink jet heater chip comprising:

a plurality of ink jet nozzles;

a plurality of data shift registers;

a plurality of latches; and a first clock signal generator on the ink jet heater chip for generating a first clock signal without using an external clock input from a printer main body, wherein the first clock signal is used to shift data into and through the data shift registers.

2. The apparatus of claim 1, further comprising a data I/O, a second clock signal generator which produces a second clock signal, an internal bus, and a set of latches that load address data bits onto the internal bus, wherein the data is input through the data I/O and, once all the data in a data cycle has been scanned into the shift registers, the second clock signal controls the set of latches that load the address data bits onto the internal bus.

3. The apparatus of claim 2, wherein the second clock signal generator is on the ink jet heater chip.

4. The apparatus of claim 3, wherein the second clock signal is derived on the ink jet heater chip from an incoming data stream.

5. The apparatus of claim 4, wherein the second clock signal is derived on the ink jet heater chip from an incoming data stream by a clock-recovery circuit.

6. The apparatus of claim 2, wherein the second clock signal generator includes a counter on the ink jet heater chip which sends a second clock signal after a predetermined number of first clock signals.

7. The apparatus of claim 3, wherein the second clock signal generator comprises an oscillator circuit which generates a continuous train of pulses at a desired frequency.

8. The apparatus of claim 7, wherein the second clock signal generator comprises an astable multivibrator circuit.

9. The apparatus of claim 7, wherein the train of pulses feeds into a Start/Stop Circuit which acts as a gate for the pulse train.

10. The apparatus of claim 9, wherein the initial state of the Start/Stop circuit is off and the first data bit in the data stream acts as the START BIT.

11. The apparatus of claim 1, wherein the first clock signal is derived on the ink jet heater chip from an incoming data stream.

12. The apparatus of claim 11, wherein the first clock signal is derived on the ink jet heater chip from an incoming data stream by a clock-recovery circuit.

13. The apparatus of claim 1, wherein the first clock signal generator comprises an oscillator circuit which generates a continuous train of pulses at a desired frequency.

14. The apparatus of claim 13, wherein the first clock signal generator comprises an astable multivibrator circuit.

15. The apparatus of claim 13, wherein the train of pulses feeds into a Start/Stop Circuit which acts as a gate for the pulse train.

16. The apparatus of claim 15, wherein the initial state of the Start/Stop circuit is off and the first data bit in the data stream acts as the START BIT.

17. The apparatus of claim 1, further comprising an ink jet print head cartridge including the ink jet heater chip.

18. The apparatus of claim 1, further comprising an inkjet print head including the ink jet heater chip.

19. The apparatus of claim 18, further comprising an ink jet printer including the inkjet print head.

20. Apparatus comprising:

an ink jet heater chip comprising:

a plurality of ink jet nozzles;

a plurality of data shift registers; and a plurality of latches; and a first clock signal generator for generating a first clock signal, wherein the first clock signal is used to shift data into and through the data shift registers;

a data I/O, a second clock signal generator which produces a second clock signal, an internal bus, and a set of latches that load address data bits onto the internal bus, wherein the data is input through the data I/O and, once all the data in a data cycle has been scanned into the shift registers, the second clock signal controls the set of latches that load the address data bits onto the internal bus, wherein:

the second clock signal generator is on the ink jet heater chip

21. The apparatus of claim 20, wherein the second clock signal generator comprises an astable multivibrator circuit.

22. Apparatus comprising:

an ink jet heater chip comprising:

a plurality of ink jet nozzles;

a plurality of data shift registers; and a plurality of latches; and a first clock signal generator for generating a first clock signal, wherein the first clock signal is used to shift data into and through the data shift registers;

a data I/O, a second clock signal generator which produces a second clock signal, an internal bus, and a set of latches that load address data bits onto the internal bus, wherein the data is input through the data I/O and, once all the data in a data cycle has been scanned into the shift registers, the second clock signal controls the set of latches that load address data bits onto the internal bus, wherein:

the second clock signal generator is on the ink jet heater chip and includes at least one of an oscillator circuit and a counter on the ink jet heater chip.

23. A method of printing comprising:

providing an ink jet printer having an ink jet heater chip comprising:

a plurality of ink jet nozzles;

a plurality of data shift registers;

a plurality of latches; and generating a first clock signal on the ink jet heater chip without using an external clock input from a printer main body, wherein the first clock signal is used to shift data into and through the data shift registers.

24. The method of claim 23, wherein the printer further comprises a data I/O, a second clock signal generator which produces a second clock signal, an internal bus, and a set of latches that load address data bits onto the internal bus, wherein the data is input through the data I/O and, once all the data in a data cycle has been scanned into the shift registers, the second clock signal controls the set of latches that load the address data bits onto the internal bus.

25. The method of claim 23, wherein the first clock signal is derived on the ink jet heater chip from an incoming data stream.

26. The method of claim 25, wherein the first clock signal is derived on the ink jet heater chip from an incoming data stream by a clock-recovery circuit.

27. The method of claim 23, wherein the first clock signal generator comprises an oscillator circuit which generates a continuous train of pulses at a desired frequency.

28. The method of claim 27, wherein the first clock signal generator comprises an astable multivibrator circuit.

29. The method of claim 27, wherein the train of pulses feeds into a Start/Stop Circuit which acts as a gate for the pulse train.

30. The method of claim 29, wherein the initial state of the Start/Stop circuit is off and the first data bit in the data stream acts as the START BIT.

* * * * *